US005452830A

United States Patent [19]

Hopkins et al.

[11] Patent Number: 5,452,830

[45] Date of Patent: Sep. 26, 1995

[54] IMPLEMENT HOLDER

[76] Inventors: Glenn S. Hopkins, 8 Continental Rd., Cornwall, N.Y. 12518; Richard P. Brown, 7 Charles Ct., Middletown, N.Y. 10940

[21] Appl. No.: 294,487

[22] Filed: Aug. 23, 1994

[51] Int. Cl.[6] ..... A45F 5/14

[52] U.S. Cl. ..... 224/252; 224/232; 224/247; 224/268; 206/372; 206/373

[58] Field of Search ..... 224/252, 253, 224/232, 247, 268, 904; 206/372, 373, 1.7

[56] References Cited

U.S. PATENT DOCUMENTS

| | | | |
|---|---|---|---|
| 1,270,158 | 6/1918 | Hill | 224/904 |
| 3,508,691 | 4/1970 | Langbehn | 224/252 |
| 4,113,156 | 9/1978 | Brito | 224/904 |
| 4,300,708 | 11/1981 | Patterman | 224/253 |
| 4,303,188 | 12/1981 | Calabrese | 224/253 |
| 4,356,916 | 11/1982 | Anglemeyer | 206/372 |
| 4,406,730 | 9/1983 | Altmix | 156/574 |
| 4,699,303 | 10/1987 | Kline | 224/252 |
| 4,757,783 | 7/1988 | Mathewy | 118/415 |
| 4,883,290 | 11/1989 | Landa | 224/252 |
| 5,052,603 | 10/1991 | Spina | 224/253 |
| 5,232,136 | 8/1993 | Unger | 224/252 |
| 5,257,695 | 11/1993 | Henke et al. | 206/373 |

*Primary Examiner*—Henry J. Recla
*Assistant Examiner*—Charles R. Eloshway

[57] ABSTRACT

A holder for implements such as a mortal board, which is to be horizontally positioned, knives, such as broad, spackle, and shear knives, which are to be positioned at an angle, and a roll of drywall tape, vertically positioned. Holder comprises a back plate to secure implements, and a second plate in which the implement holder is temporarily attached to the user, more specifically, the waist area of the user. The mortar board is inserted into the Y-shaped slots which are horizontally aligned to the back plate and are disposed in spaced relationship. The knives are inserted into the compression loaded slots having adjacent relationship and positioned at an angle from the back plate. The tape is inserted into the J-shaped hook which is spaced away from the back plate to allow for the tapes positioning and removal to and from the implement holder. The parts which comprise the implement holder are made from a rigid material, preferably aluminum. When the implements are engaged in their appropriate locations within the implement holder, both hands of the worker are free to conduct other operations.

3 Claims, 4 Drawing Sheets

IMPLEMENT HOLDER

FIELD OF THE INVENTION

This invention generally relates to an implement holder and more specifically, an implement holder suspended from the worker's body for drywall taper's tools such as a mortar board, broad, shear, and spackle knives, and drywall tape to thereby free the worker's hands for different operations.

BRIEF DESCRIPTION OF THE PRIOR ART

It is not uncommon for workers who are working with these tools to hold their appropriate tools and tape in one hand or lay them on the floor while using their other hand to work the drywall compound into and around corners and elsewhere in the drywall structure.

To facilitate the storage of the mortar board, broad, shear, and spackle knives, and drywall tape when not in use, their is a need for an implement holder which can readily store each tool and is efficiently attached to the worker so that the task of working on drywall structures becomes less complicated, and the worker is able to obtain each tool as needed with ease.

U.S. Pat. No. 5,052,603 discloses an implement holder for a mortar board which can be suspended from the belt of a worker. The holder does not provide for any other implement such as those described in the present invention. As well, the means in which the invention supports the mortar board, a protruding frame, can get in the way when the worker is doing his work.

U.S. Pat. No. 5,232,136 discloses a holder for a knife which is suspended from the worker's body, yet it does not provide for a compression means of holding an implement.

U.S. Pat. No. 4,757,783 shows a container-to-tape dispenser for drywall joint compound intended for use in a point-of-purchase container holding a supply of the compound. The dispenser includes a main body having a generally rectangular elongated base and an inverted generally U-shaped top portion. The main body is removably mounted in and extends between diametrically opposed tape entrance and exit slots formed in the container. A tape roll holder is suspended from the container adjacent the tape entrance slot and a length of tape is threaded into the dispenser using a tape threader.

This patent differs from present invention as it does not provide a means of supporting tape from the worker's body and can not support any other implement.

U.S. Pat. No. 4,406,730 discloses a drywall tape dispenser of the handheld portable type which has a tape supply roll journaled between spaced apart sidewalls for forward advancements of a drywall tape along a guide path established between a pair of pinch rolls and upwardly along a pressure roller at the leading end of the dispenser. Although this patent makes for an efficient tape dispenser, it is quite expensive to manufacture and must be held in the worker's hand to operate.

U.S. Pat. No. 4,300,708 discloses a carrier for a drywall taper's broad knife which has a main pocket for the broad knife and an auxiliary pocket for a shear knife. The carrier includes three pocket wall forming components that are preferably made from leather. No means of spring-loading or compression loading are present in this invention. Being made from leather, the invention is less durable than the present invention.

SUMMARY OF THE INVENTION

It is an object of the present invention to provide an implement holder capable of supporting a mortar board, broad, shear, and spackle knives, and drywall tape that will be suspended from the user's body.

It is another object of the present invention to provide an implement holder made from a rigid material to protect the worker from bodily harm and provide for support of drywall implements which are easily obtainable and stored.

It is yet another object of the present invention to allow for drywall implements to be stored efficiently so that the workers hands are free to work more efficiently. To allow for easy storage and access of the mortar board, the inventors provide horizontal slots and fasteners which can be adjusted to move the spacers closer together in order to secure the mortar board. Because the mortar board is not entirely secured within the Y-shaped slots, it is held by gravity as the tool bends at an angle.

The use of a compression loaded, two-piece clip firmly holds the various knives in place, one on top of the other when necessary, yet allows for removal with ease due to the appropriate amount of tension applied to the top element of the compression loaded device. The present invention also provides protection for the user from injury as each knife blade is secured under the compression loaded clip.

The J-shaped hook, also of a rigid material, securely holds the tape. The specific shape of the hook provides support for the tape so that the tape can't fall out. As well, the tape can be removed when such removal is necessary due to the appropriate spacing of the hook from the back plate.

To attach the implement holder securely to the worker, spacers and a curved plate which conforms to the hip area of ones body are provided.

A general object of the present invention is to provide a body carrier for a drywall taper's implements such as a mortar board, broad, shear, and spackle knives, and drywall tape. Yet another object of the invention is to provide an implement holder with certain safety features designed to protect the worker from injury. Yet another object is to provide a drywall taper's implement holder which utilizes pliant components in the formation of slots, a compression loaded clip, and a J-shaped hook all designed for easy insertion and removal of each implement. Other objectives of the invention are to provide an implement holder which is inexpensive to manufacture, easy to use, and comfortable to wear.

BRIEF DESCRIPTION OF THE DRAWINGS

The invention will be described now with reference to the accompanying drawings in which:

FIG. 1 is a perspective view of the implement holder taken from the front.

REFERENCE NUMERALS IN DRAWINGS

1 Implement holder in general

2 Back plate of implement holder

3 Hip plate

4 Spacer

5 Spacer

6 Spacer

7 Spacer

Figure 1:
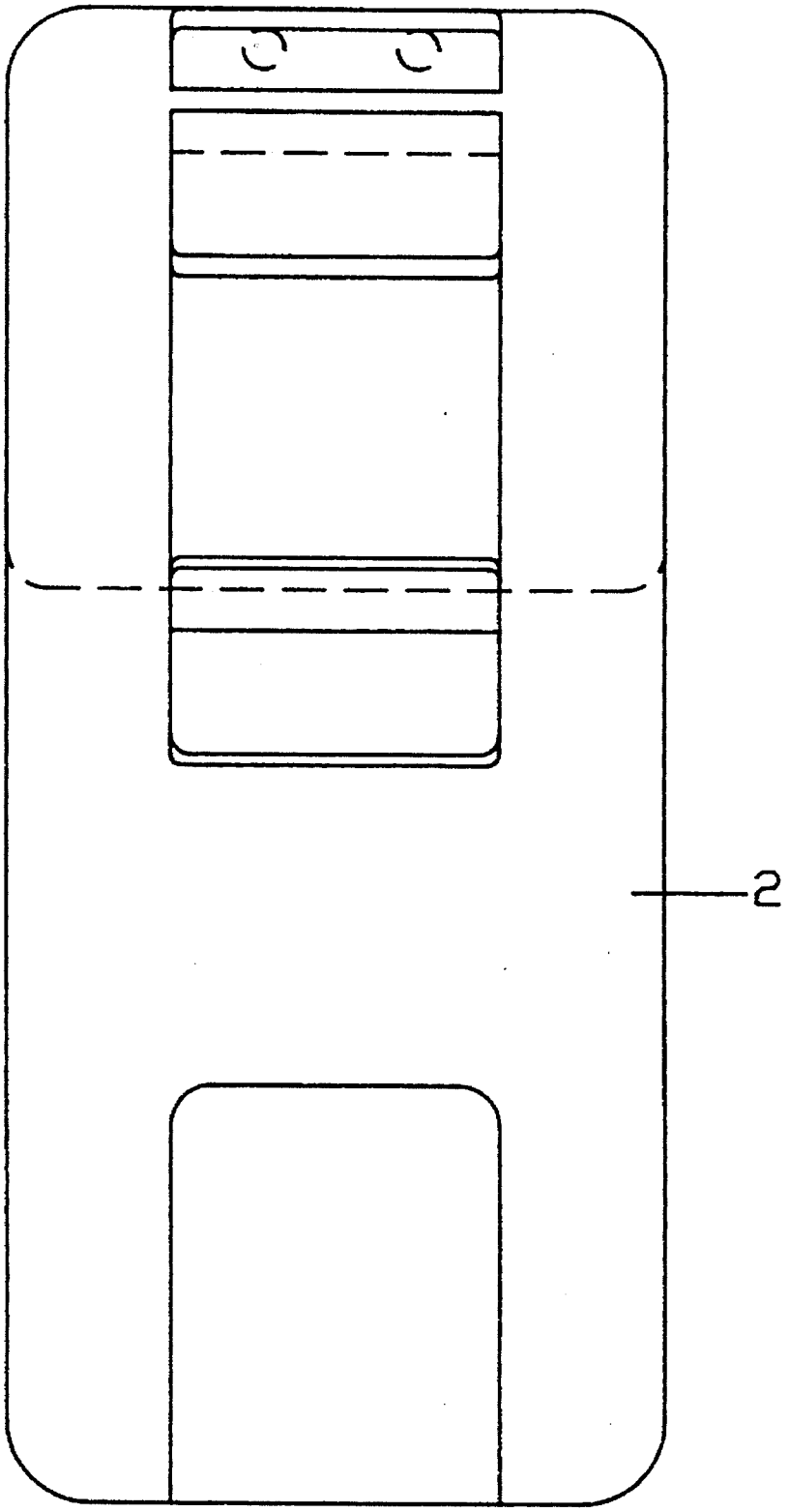
FIG. 1 is a front view of the implement holder.
Figure 2:
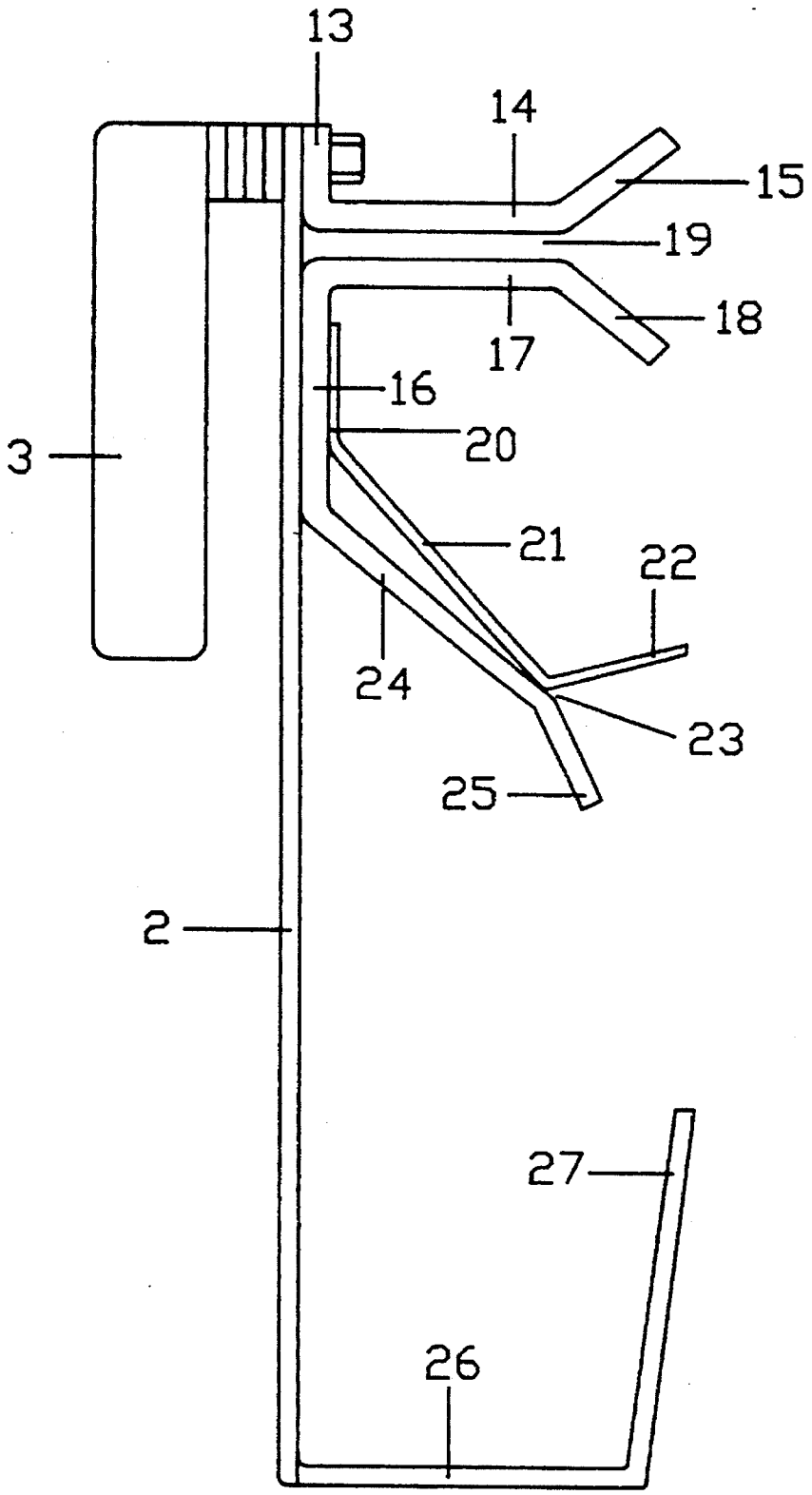
FIG. 2 is a side view of the implement holder.
Figure 3:
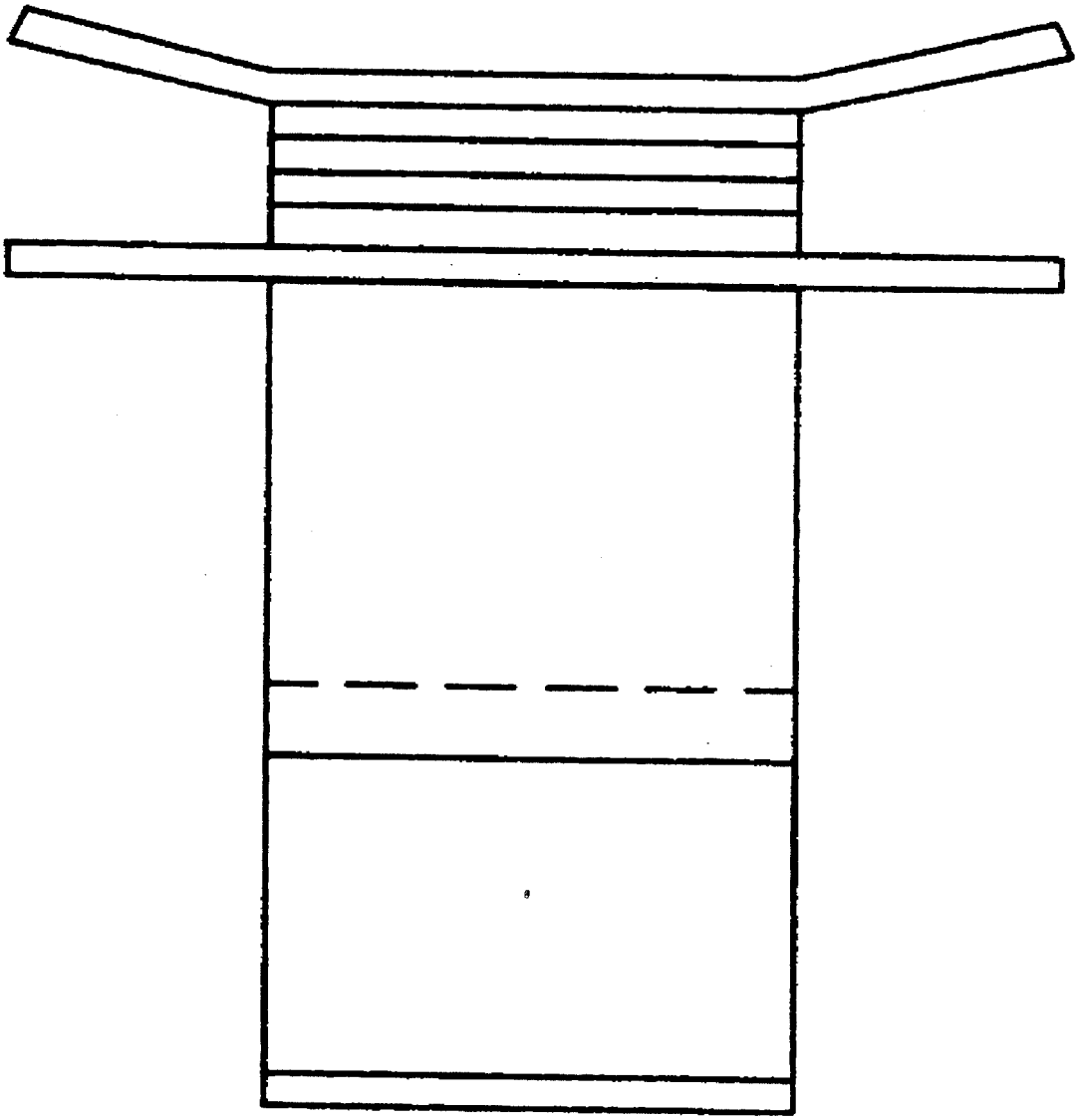
FIG. 3 is a top view of the implement holder.
Figure 4:
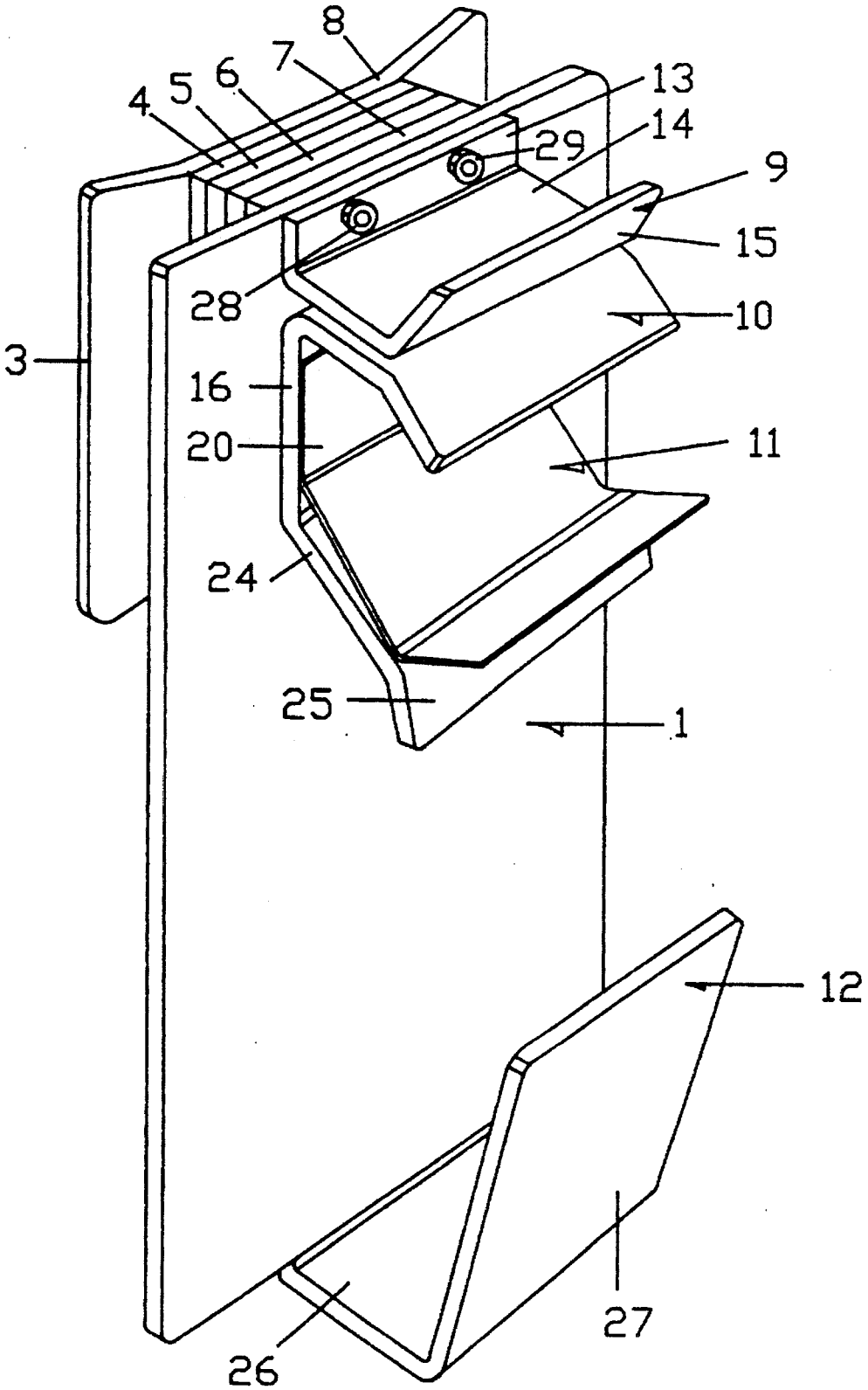
FIG. 4 is a front perspective view of the implement holder.

8 Point of contact between spacer 4 and Hip plate 3

9 Top part to secure mortar board

10 Bottom part to secure mortar board and bottom of compression clip.

11 Top part of compression clip

12 Tape holder in general

13 Point of contact for part 9 and back plate 2

14 Member of 9 used to secure mortar board within implement holder 1

14 Member of 9 bent at an angle to accept mortar board into space 19

16 Member of 10 to secure to back plate 2

17 Member of 10 to hold bottom of mortar board to implement holder 1

18 Member of 10 bent at an angle to accept mortar board into space 19

19 Space to accept mortar board

20 Member of 11 to secure 11 to 10

21 Member of 11

22 Member of 11 to accept knives

23 Compression clip

24 Member of 10

25 Member of 10 to accept knives

26 Horizontal member of 12

27 Tape securing member of 12

28 2 Fastener

29 Fastener

DESCRIPTION OF THE PREFERRED EMBODIMENT

As the drawings illustrate, the implement holder designated in general as 1, consists of the following: A back plate 2 having attached general members 9,10, 11, and general member 12 being bent from back plate 2. Also, the implement holder I consists of a means in which the worker can attach the implement holder 1 to one's body, preferably the hip area, and more specifically, the pants of a worker. This is accomplished with hip plate 3 and spacers 4,5,6,7, which are disposed in relation to 8, the flat section of 3. All parts of the present invention are made of a rigid material, preferably metal and more specifically, a light weight metal such as aluminum, and/or stainless steel.

In order for the mortar board to be secured within the implement holder, 9 and 10 must provide for space 19 to accommodate said mortar board. 9 is secured to back plate 2 with fasteners 28 and 29. The use of fasteners 28 and 29 allows the space 19 to be adjusted to accommodate a wide range of mortar board sizes. Part 9 consists of: member 13 which is the point of contact with 2, member 14 to secure the mortar board, and member 15, bent to allow for the easy insertion of a mortar board into space 19.

Part 10 has member 17 which is substantially parallel to 14 to secure the bottom of the mortar board and create space 19. 18 is bent away from 15 to create easy access for the insertion of a mortar board into space 19. Member 16 of part 10 is secured to back plate 2. Member 24 is bent at an angle and comprises the lower portion of the compression clip 23. 25 is bent at an angle to allow easy insertion of the various knives, although the invention is not limited to knives used in the trade of drywall installation and taping.

Part 11 touches 10 to create a compression loaded clip which secures one or more knives to the implement holder 1. A knife to be inserted into clip 23 can be of any width and construction.

Part 11 also consists of the following: member 20 which is secured to 10, member 21 which supports the knives used in drywall installation and taping, and member 21 which is bent away from 25 to allow for easy insertion of the knives into clip 23.

Hook 12 is used to support a roll of tape, although it is not limited to tape as an array of implements can be hung from 12. When a roll of tape is looped over 27, it will lay vertically in relationship to back plate 2 as horizontal member 26 allows for the roll of tape to rest. Member 27 is provided so that the roll of tape will be securely placed on member 26 without falling off of the implement holder 1.

What is claimed is:

1. An implement holder for supporting tools used in drywall construction, said holder comprising:

a substantially flat, vertical back plate, adapted to hang, in use, alongside a user of said holder;

a hip plate having a shape which conforms to a hip area of said user;

at least one removable spacer for attaching said back plate to said hip plate creating an adjustable space therebetween for attachment to said user;

a hook-shaped tape holder formed from an extension of a lower portion of said back plate;

a clip for holding a mortar board, said clip comprised of an upper part fastened by at least one fastener to said back plate and a lower part attached to said back plate at a distance below said upper part, thereby forming a gap between said upper and lower parts for receiving said mortar board therein; and, a compression clip for holding spackle knives, said compression clip comprised of an outward extension of said lower part of said mortar board clip, and a compression member fastened to said lower part of said mortar board clip, said compression member having an outer end which is biased against said outward extension to secure said knives therebetween.

2. An implement holder according to claim 1, wherein said holder is constructed from the group of materials consisting of aluminum, plastics, and wood.

3. An implement holder according to claim 1, wherein said at least one fastener and said upper part of said mortar board clip can be moved vertically with respect to said back plate, allowing adjustment of said gap.

* * * * *